US010633172B2

(12) United States Patent
Rapparini et al.

(10) Patent No.: US 10,633,172 B2
(45) Date of Patent: Apr. 28, 2020

(54) SYSTEM FOR OBTAINING BEVERAGES AND METHOD FOR PRODUCING SAME

(71) Applicant: Aroma System s.r.l., Bologna (IT)

(72) Inventors: Gino Rapparini, Bologna (IT); Maurizio Generali, Bologna (IT)

(73) Assignee: Aroma System S.R.L., Bologna (IT)

( * ) Notice: Subject to any disclaimer, the term of this patent is extended or adjusted under 35 U.S.C. 154(b) by 326 days.

(21) Appl. No.: 15/462,834

(22) Filed: Mar. 18, 2017

(65) Prior Publication Data

US 2017/0275085 A1 Sep. 28, 2017

(30) Foreign Application Priority Data

Mar. 22, 2016 (IT) ..... 10201630005

(51) Int. Cl.

| | |
|---|---|
| ***B65D 85/804*** | (2006.01) |
| ***B65B 29/02*** | (2006.01) |
| ***B65B 1/02*** | (2006.01) |
| ***B65B 7/28*** | (2006.01) |
| ***B65B 47/02*** | (2006.01) |

(52) U.S. Cl.

CPC ..... *B65D 85/8043* (2013.01); *B65B 1/02* (2013.01); *B65B 7/28* (2013.01); *B65B 29/02* (2013.01); *B65B 29/022* (2017.08); *B65B 47/02* (2013.01)

(58) Field of Classification Search

CPC B65B 1/02; B65B 7/28; B65B 7/2842; B65B 29/02; B65B 29/022; B65B 47/00

USPC ..... 53/410, 453, 471, 128.1, 559, 281

See application file for complete search history.

(56) References Cited

U.S. PATENT DOCUMENTS

| | | | | |
|---|---|---|---|---|
| 4,359,852 | A * | 11/1982 | Hoffman | B65D 77/2088 206/306 |
| 4,874,618 | A * | 10/1989 | Seaborne | A23G 9/04 426/76 |
| 4,982,555 | A * | 1/1991 | Ingemann | B65B 31/028 53/405 |
| 5,566,529 | A * | 10/1996 | Sireix | B65D 3/262 53/412 |
| 5,840,186 | A | 11/1998 | Sylvan et al. | 210/474 |
| 5,947,278 | A * | 9/1999 | Sawhney | A61C 19/006 206/216 |

(Continued)

FOREIGN PATENT DOCUMENTS

| | | |
|---|---|---|
| EP | 1837294 | 9/2006 |
| WO | WO 2013064988 | 5/2013 |

(Continued)

OTHER PUBLICATIONS

Italian Search Report from Italian application No. 102016000030005 dated Sep. 7, 2016, 7 pages.

*Primary Examiner* — Hemant Desai
*Assistant Examiner* — Christopher Robin Kim
(74) *Attorney, Agent, or Firm* — Fattibene and Fattibene LLC; Paul A. Fattibene

(57) ABSTRACT

A system for producing beverages comprising a capsule fixed to a reinforcement element, for example a reinforcement ring or a container that encloses the capsule, and a method for producing such a system for obtaining beverages. The reinforcement element comprises an upper annular edge to which the lid of the capsule is fixed. There is no filtering thermoformable material of the capsule between the upper annular edge and the lid of the capsule.

11 Claims, 3 Drawing Sheets

(56) References Cited

U.S. PATENT DOCUMENTS 6,058,682 A * 5/2000 Pajak ..... B65B 7/164 53/329.2
6,645,537 B2 11/2003 Sweeney et al. ..... 426/79
8,474,368 B2 7/2013 Kilber et al. ..... 99/295
8,539,743 B2 * 9/2013 Rapparini ..... B65B 9/042 53/561
2005/0051478 A1 3/2005 Karanikos et al. ..... 210/469
2005/0102978 A1 * 5/2005 Gueret ..... A45D 34/042 53/471
2012/0097602 A1 4/2012 Tedford ..... 210/500.1
2012/0269933 A1 10/2012 Rapparini ..... 426/82
2014/0230370 A1 * 8/2014 Bianchi ..... B65B 29/02 53/410
2014/0308406 A1 10/2014 O'Brien et al. ..... 426/115
2014/0331611 A1 * 11/2014 Meyer ..... B29C 65/18 53/445
2015/0056341 A1 * 2/2015 Trombetta ..... B65D 85/8043 426/115
2015/0128525 A1 * 5/2015 Bartoli ..... B29C 51/04 53/410
2015/0166204 A1 6/2015 Rea et al. ..... B65B 29/02
2015/0175347 A1 6/2015 Empl ..... B65D 85/8046
2016/0122080 A1 * 5/2016 Blatstein ..... B65D 21/0228 220/500
2017/0210534 A1 * 7/2017 Rapparini ..... B65D 85/8043
2017/0275085 A1 * 9/2017 Rapparini ..... B65B 1/02
2018/0022012 A1 * 1/2018 Rapparini ..... B29C 51/421 156/242
2018/0215120 A1 * 8/2018 Rapparini ..... B65B 29/022

FOREIGN PATENT DOCUMENTS

WO WO 2013189555 12/2013
WO WO 2013189923 12/2013
WO WO 2014168940 10/2014

* cited by examiner

SYSTEM FOR OBTAINING BEVERAGES AND METHOD FOR PRODUCING SAME

FIELD OF THE INVENTION

The present invention relates to a system for obtaining beverages comprising a capsule which is fixed to a reinforcement element, for example a reinforcement ring or a container which encloses the capsule. Moreover, the present invention relates to a method for forming such a system for producing beverages.

BACKGROUND OF THE INVENTION

FIG. 1 shows a capsule 100 for obtaining beverages known from the prior art. The capsule 100 is made of a filtering thermoformable material, for example SMASH™. The capsule 100 is placed inside a container 200 which is made of a barrier material, in particular a barrier material for oxygen. The container 200 is closed by means of a lid 300 made of a barrier material, in particular a barrier material for oxygen.

As shown in the enlargement of FIG. 1, the container 200 comprises a containment body 201 adapted to contain the capsule 100. The container 200 further comprises an upper annular edge 202 on which the lid 300 is fixed. The upper annular edge 202 is joined to the body 201 of the container 200 by means of a lateral vertical edge 203 and a horizontal edge 204.

The capsule 100 is made by thermoforming a disc of filtering thermoformable material. The disc is fixed to the upper annular edge 202. Subsequently, the body of the capsule 100 is thermoformed starting from the disc fixed to the upper annular edge 202. In this way, as can be seen in FIG. 1, a layer 101 of filtering and thermoformable material is interposed between the upper annular edge 202 and the lid 300.

This is problematic. First of all, the adhesion between the lid 300 and the filtering thermoformable material is not optimal. This renders the fixing process of the lid 300 to the system difficult. In order to properly fix the lid 300 to the layer 101 it is necessary to adopt complex and costly techniques, such as for example ultrasonic welding.

Moreover, it was observed that even if the lid 300 is properly fixed to the layer 101 of filtering and thermoformable material, this region of the capsule is in any case a critical region which does not guarantee the impermeability to oxygen. It was in fact observed that the product contained in the capsule deteriorates in any case in a short time. This is due to the fact that oxygen reaches the product contained in the capsule through the layer 101 of filtering and thermoformable material interposed between the upper annular edge 202 and the lid 300.

The present invention faces these problems.

SUMMARY OF THE INVENTION

According to the present invention, the filtering and thermoformable material of the capsule is not fixed to the upper annular edge of the reinforcement element. In particular, according to the present invention, the filtering and thermoformable material is not present between the upper annular edge of the reinforcement element and the lid. This allows fixing directly the lid, which may be made of barrier material, for example, a barrier material for oxygen, to the upper annular edge of the reinforcement element, which may be also made of barrier material, for example a barrier material for oxygen.

According to an embodiment of the present invention, a method for forming a system for producing beverages comprising a capsule made of filtering thermoformable material and fixed to a reinforcement element is provided, comprising the following steps:

- providing a reinforcement element comprising an upper annular edge adapted to support the lid of the capsule, a vertical edge and a horizontal edge, wherein the vertical edge links the upper annular edge to the horizontal edge;
- providing a disc of filtering thermoformable material;
- fixing the disc of filtering thermoformable material to the vertical edge and/or to the horizontal edge so that no filtering thermoformable material is present on the upper annular edge; and
- thermoforming the containment volume of the capsule from the disc.

According to a further embodiment of the present invention, a method is provided, wherein fixing the disc comprises welding the disc to the vertical edge and/or to the horizontal edge. Still according to a further embodiment, fixing the disc is realized solely by means of welding.

According to a further embodiment of the present invention, a method is provided wherein thermoforming is performed after fixing.

According to a further embodiment of the present invention, a method is provided wherein the reinforcement element is a reinforcement ring.

According to a further embodiment of the present invention, a method is provided wherein the reinforcement element is a container, for example a cup-like or a glass-like container, preferably made of a barrier material, for example a material which is a barrier for oxygen, wherein the containment volume of the container is linked to the upper annular edge through the horizontal edge and the vertical edge.

According to a further embodiment of the present invention, a method is provided further comprising the following steps:

- filling the containment volume of the capsule with the product; and
- fixing a lid to the upper annular edge so as to close the capsule.

According to a further embodiment of the present invention, a method is provided, wherein the lid is made of a barrier material, for example a material which is a barrier for oxygen.

According to a further embodiment of the present invention, a system for producing beverages comprising a capsule made of filtering thermoformable material and fixed to a reinforcement element is provided, wherein the reinforcement element comprises an upper annular edge adapted to support the lid of the capsule, a vertical edge and a horizontal edge, wherein the vertical edge links the upper annular edge to the horizontal edge, and wherein the filtering thermoformable material of the capsule is fixed, for example is welded, to the vertical edge and/or to the horizontal edge so that there is no thermoformable material between the upper annular edge and the lid.

According to a further embodiment of the present invention, a system is provided wherein the reinforcement element is a reinforcement ring.

According to a further embodiment of the present invention, a system is provided wherein the reinforcement element is a container, for example a cup or a glass-like container, preferably made of a barrier material, for example a material which is a barrier for oxygen, wherein the containment volume of the container is linked to the upper annular edge through the horizontal edge and the vertical edge.

DETAILED DESCRIPTION OF THE PREFERRED EMBODIMENTS

Figure 1:
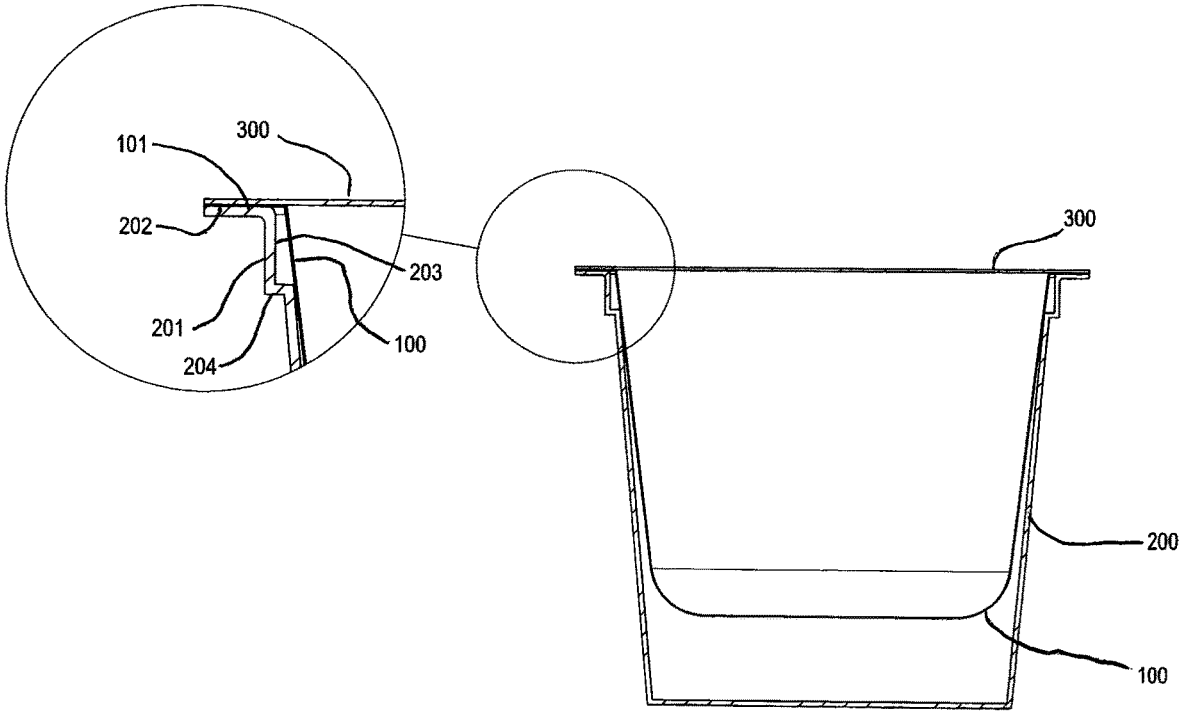
FIG.1 (Prior Art)
FIG. 1 schematically illustrates a capsule for obtaining beverages known from the prior art with an enlarged portion.
Figure 2:
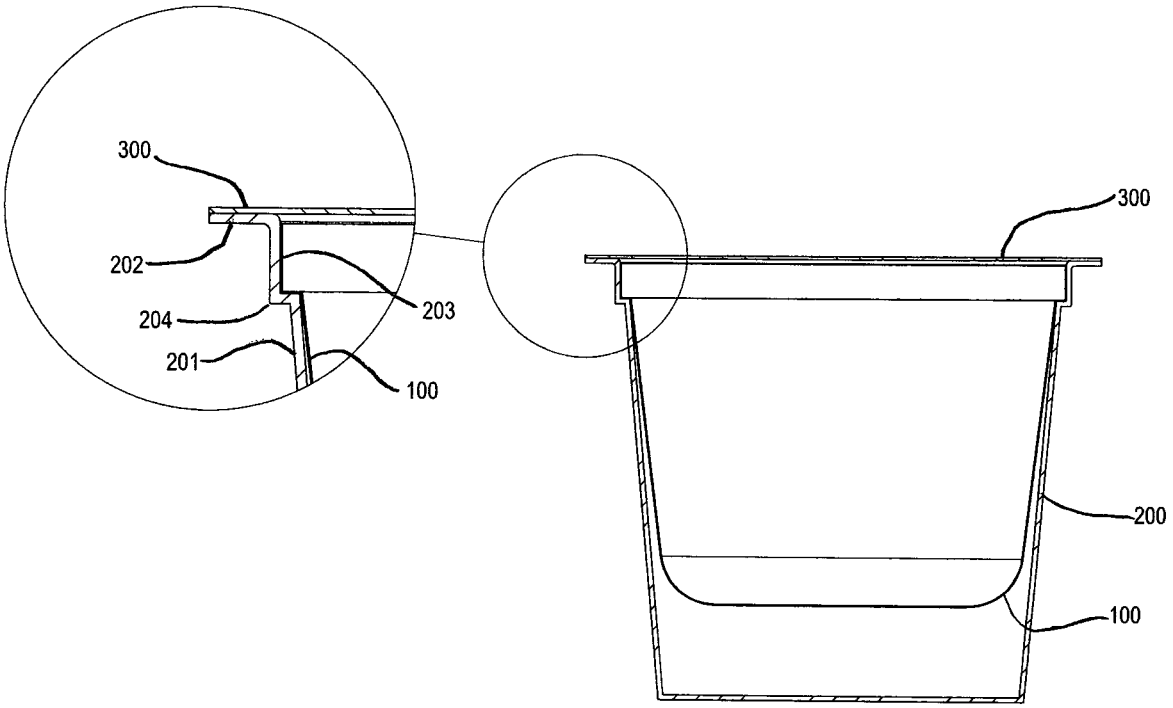
FIG. 2 schematically illustrates a system for obtaining beverages of an embodiment of the present invention comprising a capsule with an enlarged portion.

FIG. 2 shows a system comprising a capsule 100 fixed to a container 200 according to an embodiment of the present invention.

The capsule 100 is made of a filtering thermoformable material, for example SMASH™. The capsule 100 is placed inside a container 200 made of barrier material, in particular a material which is a barrier for oxygen. The container 200 is closed by means of a lid 300 made of barrier material, in particular a material which is a barrier for oxygen.

The container 200 comprises a containment body 201 adapted to contain the capsule 100.

The container 200 further comprises an upper annular edge 202 on which the lid 300 is fixed. The upper annular edge 202 is linked to the body 201 of the container 200 by means of a vertical edge 203 and a horizontal edge 204.

According to the present invention, the filtering thermoformable material of the capsule 100 is fixed to the container 200 by means of welding to the lateral vertical edge 203 and/or to the horizontal edge 204. In this way, there is no filtering thermoformable material between the lid 300 and the upper annular edge 202 of the container 200. This allows easily fixing the lid 300 to the upper annular edge 202 of the container 200. Moreover, the welding region between the lid 300 and the upper annular edge 202 is a region which guarantees an optimum seal with respect to oxygen, thus allowing the preservation of the product contained in the capsule 100 since there is no filtering thermoformable material in this region.

Figure 3:
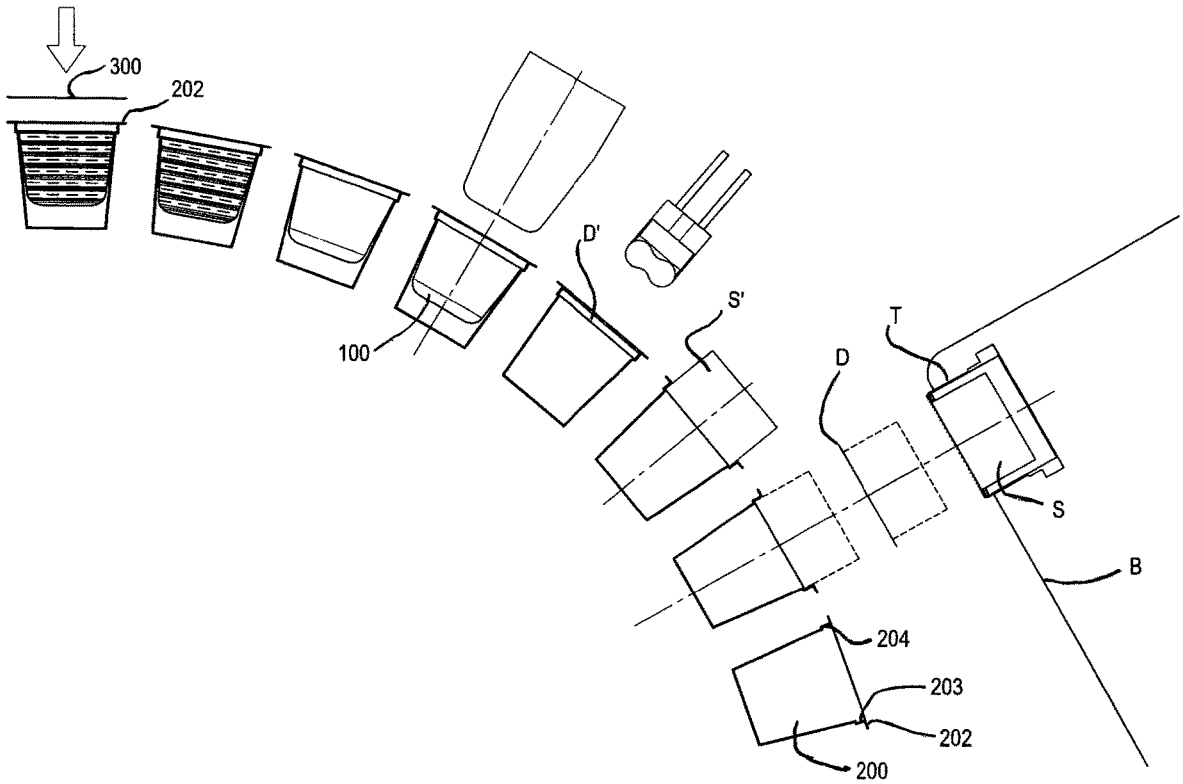
FIG. 3 schematically illustrates the method steps for forming a system for producing beverages comprising a capsule.

FIG. 3 schematically shows the steps of a method for forming a system for producing beverages comprising a capsule 100 made of filtering thermoformable material fixed to a reinforcement element 200 according to an embodiment of the present invention. In particular, FIG. 3 shows the steps of the method performed in different stations of a system of the rotary type. The stations are accordingly placed along a circumference. Alternatively, the method according to the present invention may be performed in a linear system.

A reinforcement element 200 is provided comprising an upper annular edge 202, a vertical edge 203 and a horizontal edge 204, wherein the vertical edge 203 links the upper annular edge 202 to the horizontal edge 204.

A disc D of filtering thermoformable material is provided by cutting by means of a tool T from a reel B.

The disc D is moved so as to place it on the upper annular edge 202 of the reinforcement element by means of the preheated element S and, continuing the displacement along the axis of the container 200, the disc D is pushed towards the horizontal edge 204 so that the side edge of the disc at least partially covers and at least partially adheres to the vertical edge 203.

With respect to the dimensions defined by the elements of the container 200, the disc D is dimensioned so that following the pushing of the disc D towards the horizontal edge 204 by means of the element S, there is no filtering thermoformable material which is left on the upper annular edge 202. The filtering thermoformable material only adheres to the vertical edge 203 by a length which is equal to, or lower than, the maximum total height of the vertical edge 203.

The disc D is firmly fixed to the horizontal edge 204, for example by means of welding. In this step, it is possible to fix, at least partially, the disc D also to the vertical edge 203. A second fixing step can accordingly be performed wherein the disc D is fixed to the vertical edge 203 by means of element S'.

The thermoforming of portion D' of disc D which is free from welding regions if performed, so as to obtain the containment volume of the capsule 100 made of filtering thermoformable material.

Prior to the thermoforming step, it is possible to optionally advantageously perform a pre-heating step of the portion D' of the disc D so as to simplify and optimize the thermoforming process.

Subsequently, it is possible to fill the containment volume of the capsule 100.

Finally, the lid 300 is fixed to the system. In particular, the lid 300 is fixed directly to the upper annular edge 202 of the reinforcement element 200. There is no layer of filtering thermoformable material between the lid 300 and the upper annular edge 202. The lid 300 may be welded, for example thermo welded, to the upper annular edge 202.

Even if in the embodiments described above with reference to the figures a case was shown wherein the reinforcement element 200 is a container, for example a cup which completely encloses the capsule 100, the reinforcement element may even be a reinforcement ring.

In case the reinforcement element 200 is a container, for example a cup, is particularly advantageous because it allows completely enclosing the capsule in a hermetic way with respect to the outside. In particular, the container 200 and the lid 300 define an enclosed volume which is hermetically sealed and which prevents oxygen from reaching the product contained in the containment volume of the capsule so that its organoleptic properties are maintained for a long time.

As shown in the figures, the containment volume 201 of the container 200 which is cup-shaped is linked to the upper annular edge 202 of the container 200 by means of the horizontal edge 204 and the vertical edge 203.

The present invention is not limited to the embodiments described with reference to the figures but only by the scope of protection of the following claims.

What is claimed is:

1. A method for forming a system for producing beverages comprising a capsule made of filtering thermoformable material and fixed to a reinforcement element, comprising the steps of:

providing a reinforcement element comprising an upper annular edge adapted to support a lid of the capsule, a vertical edge, and a horizontal edge, wherein the vertical edge connects the upper annular edge to the horizontal edge;

providing a disc of filtering thermoformable material;

attaching said disc of filtering thermoformable material to said vertical edge and/or to said horizontal edge so that no portion of said disc of filtering thermoformable material covers said upper annular edge; and thermoforming a containment volume of the capsule from said disc of filtering thermoformable material; and fixing the lid to said upper annular edge.

2. The method according to claim 1, wherein said thermoforming is performed after said step of attaching.

3. The method according to claim 1, wherein said reinforcement element is a reinforcement ring.

4. The method according to claim 1, wherein said reinforcement element is a container, wherein the container is linked to the upper annular edge through the horizontal edge and the vertical edge.

5. The method according to claim 4, wherein the container is a cup.

6. The method according to claim 4, wherein the container is made of a barrier material.

7. The method according to claim 1, further comprising the following step:

filling the containment volume of said capsule with a product.

8. The method according to claim 7, wherein the lid is made of a barrier material.

9. A method for forming a system for producing beverages comprising a capsule made of filtering thermoformable material and attached to a reinforcement element, comprising the steps of:

providing a reinforcement element, the reinforcement element comprising an upper annular surface and a sidewall extending transversely from the upper annular surface, the sidewall comprising a vertical edge portion and a horizontal edge portion, wherein the vertical edge portion connects the upper annular edge surface to the horizontal edge portion;

providing a filtering thermoformable material;

attaching the filtering thermoformable material directly to the sidewall of the reinforcement element without any portion of the filtering thermoformable material attaching directly to the upper annular surface; and thermoforming a containment volume from the filtering thermoformable material, wherein the containment volume is placed within the reinforcement element; and fixing a lid to the upper annular surface whereby the filtering thermoformable material is not directly attached to the upper annular surface of the reinforcement element permitting a barrier material to be capable of forming a seal on the upper annular surface.

10. A method for forming a system for producing beverages comprising a capsule made of filtering thermoformable material and attached to a reinforcement element as in claim 9, wherein:

the filtering thermoformable material is attached to the vertical edge portion of the sidewall.

11. A method for forming a system for producing beverages comprising a capsule made of filtering thermoformable material and attached to a reinforcement element as in claim 9, wherein:

the filtering thermoformable material is attached to the horizontal edge portion of the sidewall.

* * * * *